US009362689B2

(12) United States Patent
Lo et al.

(10) Patent No.: US 9,362,689 B2
(45) Date of Patent: Jun. 7, 2016

(54) SYSTEM AND METHOD FOR DETECTING THE GROUND AND MICROPHONE INPUT CONTACTS IN AN AUDIO PLUG

(71) Applicants: Chi Wah Lo, Hong Kong (HK); Hwai Sian Tsai, Hong Kong (HK); Ka Leong Tony Tsang, Hong Kong (HK)

(72) Inventors: Chi Wah Lo, Hong Kong (HK); Hwai Sian Tsai, Hong Kong (HK); Ka Leong Tony Tsang, Hong Kong (HK)

(73) Assignee: BBPOS LIMITED, Hong Kong (HK)

( * ) Notice: Subject to any disclaimer, the term of this patent is extended or adjusted under 35 U.S.C. 154(b) by 231 days.

(21) Appl. No.: 13/938,788

(22) Filed: Jul. 10, 2013

(65) Prior Publication Data

US 2014/0017955 A1 Jan. 16, 2014

Related U.S. Application Data

(60) Provisional application No. 61/671,119, filed on Jul. 13, 2012.

(51) Int. Cl.

| | |
|---|---|
| ***H04R 9/06*** | (2006.01) |
| ***H01R 13/703*** | (2006.01) |
| ***H04R 5/04*** | (2006.01) |
| *H04R 1/10* | (2006.01) |
| *H01R 24/58* | (2011.01) |
| *H01R 107/00* | (2006.01) |

(52) U.S. Cl.

CPC ..... *H01R 13/703* (2013.01); *H04R 5/04* (2013.01); *H01R 24/58* (2013.01); *H01R 2107/00* (2013.01); *H04R 2420/05* (2013.01); *H04R 2420/09* (2013.01)

(58) Field of Classification Search

CPC .. H01R 24/58; H01R 2107/00; H01R 13/703; H04R 5/04; H04R 2420/05; H04R 2420/09; H04R 24/58

USPC ..... 381/58, 74, 334; 340/533

See application file for complete search history.

(56) References Cited

U.S. PATENT DOCUMENTS

| | | | | |
|---|---|---|---|---|
| 2006/0182047 | A1 | 8/2006 | Ibe | |
| 2008/0164994 | A1* | 7/2008 | Johnson | H01R 13/703 340/533 |
| 2012/0237051 | A1* | 9/2012 | Lee | H01R 13/66 381/74 |

FOREIGN PATENT DOCUMENTS

| | | | |
|---|---|---|---|
| CN | 102035911 | A | 4/2011 |
| CN | 102300003 | A | 12/2011 |
| CN | 102509221 | A | 6/2012 |
| WO | WO2011093998 | A1 | 8/2011 |

OTHER PUBLICATIONS

SIPO; International Search Report; Oct. 17, 2013; entire document.

* cited by examiner

*Primary Examiner* — Vivian Chin
*Assistant Examiner* — Ammar Hamid
(74) *Attorney, Agent, or Firm* — Howison & Arnott, LLP

(57) ABSTRACT

A circuit for detecting the position of the signal MIC-IN and GND on the audio plug of a mobile phone includes two comparators and two switches. The comparators compare the voltage difference between the two contact points representing MIC-IN and GND of the audio plug of a mobile phone, and through this comparison the ground signal of the mobile phone is identified. The circuit then connects the ground of the accessory and the mobile phone properly, by activating the appropriate switch.

18 Claims, 5 Drawing Sheets

SYSTEM AND METHOD FOR DETECTING THE GROUND AND MICROPHONE INPUT CONTACTS IN AN AUDIO PLUG

CROSS REFERENCE TO RELATED CO-PENDING APPLICATIONS

This application claims the benefit of U.S. provisional application Ser. No. 61/671,119 filed on Jul. 13, 2012 and entitled SYSTEM AND METHOD FOR DETECTING THE GROUND AND MICROPHONE INPUT CONTACTS IN AN AUDIO PLUG, which is commonly assigned, and the contents of which are expressly incorporated herein by reference.

FIELD OF THE INVENTION

The present invention relates to a system and a method for detecting the ground and microphone input contacts in an audio plug of a mobile communication device.

BACKGROUND OF THE INVENTION

Portable personal computing devices such as smart phones, Personal Digital Assistants (PDA), portable computers, tablet computers and audio devices such as digital music players have become ubiquitous in recent years. These devices usually have different built-in physical electrical interfaces such as USB, FireWire, RS232 serial port and audio plug, among others. In almost all of these devices, and in particular in the audio devices, the audio plug is a common interface. The audio plug of a device acts as a receptacle for an audio jack connector which is used for transmitting analog signals including audio signals. The audio plug may also be used to connect to headphones, speakers, microphones, and hands-free devices, among others.

Previously, many mobile phones used to have their own proprietary form of audio plugs configured to be used with cables outfitted with matching proprietary audio jacks. However, recently the functionality of mobile phones has changed so much that most mobile phones are now also digital music players, payment devices, navigation devices and cameras, among others. Additional accessory devices including headphones, printers, and card readers, among others, may be connected to the mobile phones in order to listen to music, print and complete payments, among others. Therefore, due to these added functionalities and the need to connect additional accessory devices to mobile phones, 2.5 mm audio plugs and/or 3.5 mm audio plugs can now be found on most middle to high-end mobile phones. In order for an accessory device to connect and communicate properly with a mobile phone via an audio jack, a common ground between the accessory device and the mobile phone must be established. Otherwise, signals transmitted from the accessory device cannot be interpreted properly by the mobile phone.

Most 4-pole audio plugs include four contact points that are connected to the Left-channel of stereo sound output (L-CH), Right-channel of stereo output (R-CH), Microphone input (MIC-IN) and the ground (GND) of the mobile phone respectively. However, the arrangement of these contact points on an audio plug is not standardized yet. The contact point of MIC-IN and GND may be reversed in some mobile phones. Hence, at least two different designs of the accessory devices are required to make them compatible with all mobile phones. This is not desirable for the merchants, because it increases the number of Stock Keeping Units (SKU) of an accessory device. This is also not desirable for the consumers, because it makes it difficult to identify and choose a suitable accessory device for their mobile phones.

Accordingly, there is a need for a method of identifying the specific GND and MIC-IN configuration in the audio plug of a mobile phone.

SUMMARY OF THE INVENTION

In general, in one aspect the invention provides a system comprising a mobile computing device, a peripheral device and a circuit. The mobile computing device includes an audio plug that has first and second contacts. The peripheral device includes an audio jack, and a microprocessor. The circuit connects the audio jack and the microprocessor and is used for detecting a microphone-in (MIC-IN) and a ground (GND) among the first and second contacts of the audio plug, wherein the MIC-IN has a higher voltage than the GND.

Implementations of this aspect of the invention may include one or more of the following features. The circuit includes a first comparator connected to a first switch and a second comparator connected to a second switch. The first comparator connects to the first and second contacts of the audio plug and measures a first voltage between the first and second contacts and the second comparator connects to the first and second contacts of the audio plug in a reverse way and measures a second voltage between the first and second contacts. The circuit further compares the first and second voltages between the first and second contacts and thereby identifies the MIC-IN and GND among the first and second contacts of the audio plug. The circuit further includes a resistor connected between first and second inputs of the first comparator and the first and second inputs of the first comparator are connected to the first and second contacts of the audio plug and the resistor is used to establish the first voltage between the first and second inputs of the first comparator and the first and second contacts of the audio plug. The resistor is further connected between first and second inputs of the second comparator and the first and second inputs of the second comparator are connected to the second and first contacts of the audio plug and the resistor is used to establish the second voltage between the first and second inputs of the second comparator and the second and first contacts of the audio plug. If the first voltage is low and the second voltage is high, the circuit turns the first switch on and the second switch off. If the first voltage is high and the second voltage is low, the circuit turns the second switch on and the first switch off. The first and second comparators comprise operational amplifiers. The first and second switches comprise N-MOS transistors. The circuit includes a comparator connected to a first switch and an inverter receiving input from the comparator and being connected to a second switch. The first comparator connects to the first and second contacts of the audio plug and measures a first voltage between the first and second contacts and the inverter receives the first voltage from the comparator and reverses the sign of the first voltage thereby generating a second voltage and the circuit further compares the first and second voltages and thereby identifies the MIC-IN and GND among the first and second contacts of the audio plug. If the first voltage is high and the second voltage is low, the circuit turns the first switch on and the second switch off. If the first voltage is low and the second voltage is high, the circuit turns the second switch on and the first switch off. The circuit includes a first switch and a second switch and each of the first and second switches comprises N-MOS transistors. The first switch connects to the first and second contacts of the audio plug and the second switch connects to the first and second contacts of the audio plug in a reverse way. The audio jack connector comprises a ground (GND) contact, a microphone-in (MIC-IN) contact and one or more earphone channel contacts. The audio jack may be a 4-contact Tip-Ring-Ring-Sleeve (TRRS) connector, 3-contact Tip-Ring-Sleeve (TRS) connector, a 3.5 mm audio jack, a 6.35 mm audio jack, a 2.5 mm audio jack, RCA connector, XLR connector, a banana connector, mono or stereo versions thereof. The audio plug further includes one or more earphone channel contacts configured to connect to the audio jack one or more earphone channel contacts, respectively. The mobile computing device may be a mobile phone, a personal digital assistant (PDA), netbook, tablet computer, notebook computer, game console, e-book reader, portable video player, or digital audio player. The peripheral device may be a payment card reader, magnetic card reader, a printer, headphones, speakers, microphones, or hands-free versions thereof.

In general, in one aspect the invention provides a method for detecting a microphone-in (MIC-IN) and a ground (GND) in a mobile computing device. The method includes providing a mobile computing device comprising an audio plug. The audio plug comprises first and second contacts. Next, providing a peripheral device comprising an audio jack, and a microprocessor, and then providing a circuit connecting the audio jack and the microprocessor and used for detecting a microphone-in (MIC-IN) and a ground (GND) among the first and second contacts of the audio plug, wherein the MIC-IN has a higher voltage than the GND.

DETAILED DESCRIPTION OF THE INVENTION

The present invention provides a circuit for detecting the position of the signal MIC-IN and GND on the audio plug of a mobile phone. The circuit includes two comparators and two switches. The comparators compare the voltage difference between the two contact points representing MIC-IN and GND of the audio plug of a mobile phone, and through this comparison the ground signal of the mobile phone is identified. The circuit then connects the ground of the accessory and the mobile phone properly, by activating the appropriate switch. The invention enables one single design of an accessory to be compatible to two different configurations of the audio plug on mobile phones.

The invention applies also to 3-pole arrangement where there is only a MONO audio signal instead of two stereo left and right audio channels (L-CH, R-CH). The invention may also be applied to other possible jack and plug configurations with MIC-IN and GND signals.

The invention applies to all different types of computing devices including, but not limited to, mobile phones, personal digital assistants (PDAs), netbooks, tablet computers, notebook computers, electronic readers, digital music players and digital video players, and game consoles, among others.

Figure 1:
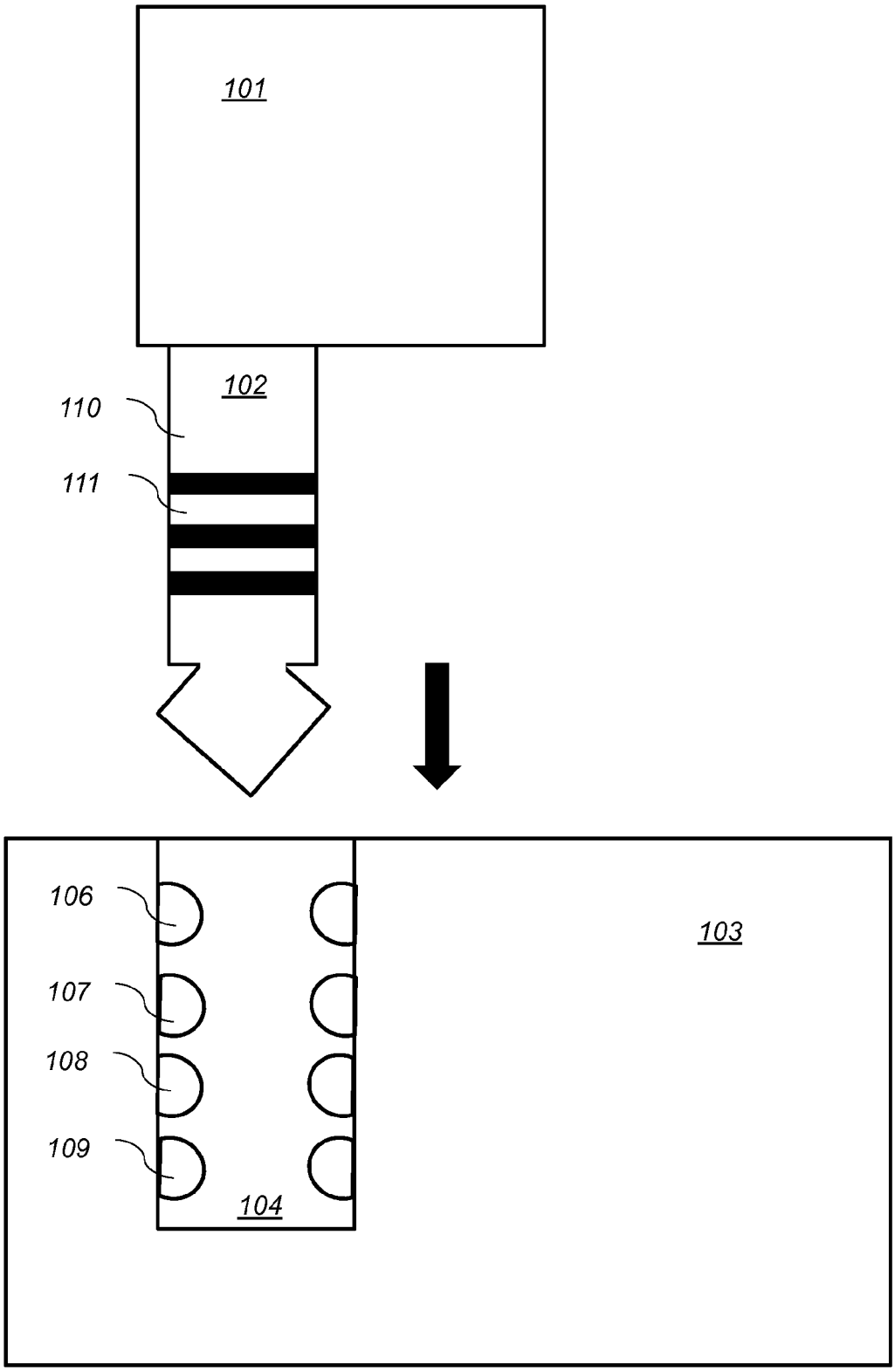
FIG. 1 shows an accessory device configured to connect to a mobile phone via an audio jack connector.

Referring to FIG. 1, accessory device 101 includes an audio jack 102 and connects to a mobile phone 103 by inserting the audio jack connector 102 into the mobile phone's audio plug 104. Audio plug 104 includes four contact points 106, 107, 108 and 109. Normally, contact points 108 and 109 are connected to the R-CH and L-CH of the stereo audio output of the mobile phone, respectively. As was mentioned above, in some models of mobile phones, contact point 107 is connected to GND and contact point 106 is connected to the MIC-IN of the mobile phone. In other models of mobile phones, contact point 107 is connected to MIC-IN and contact point 106 is connected to GND. Therefore, there are two possible arrangements of the contact points of MIC-IN and GND of the mobile phone's audio plug.

Figure 2:
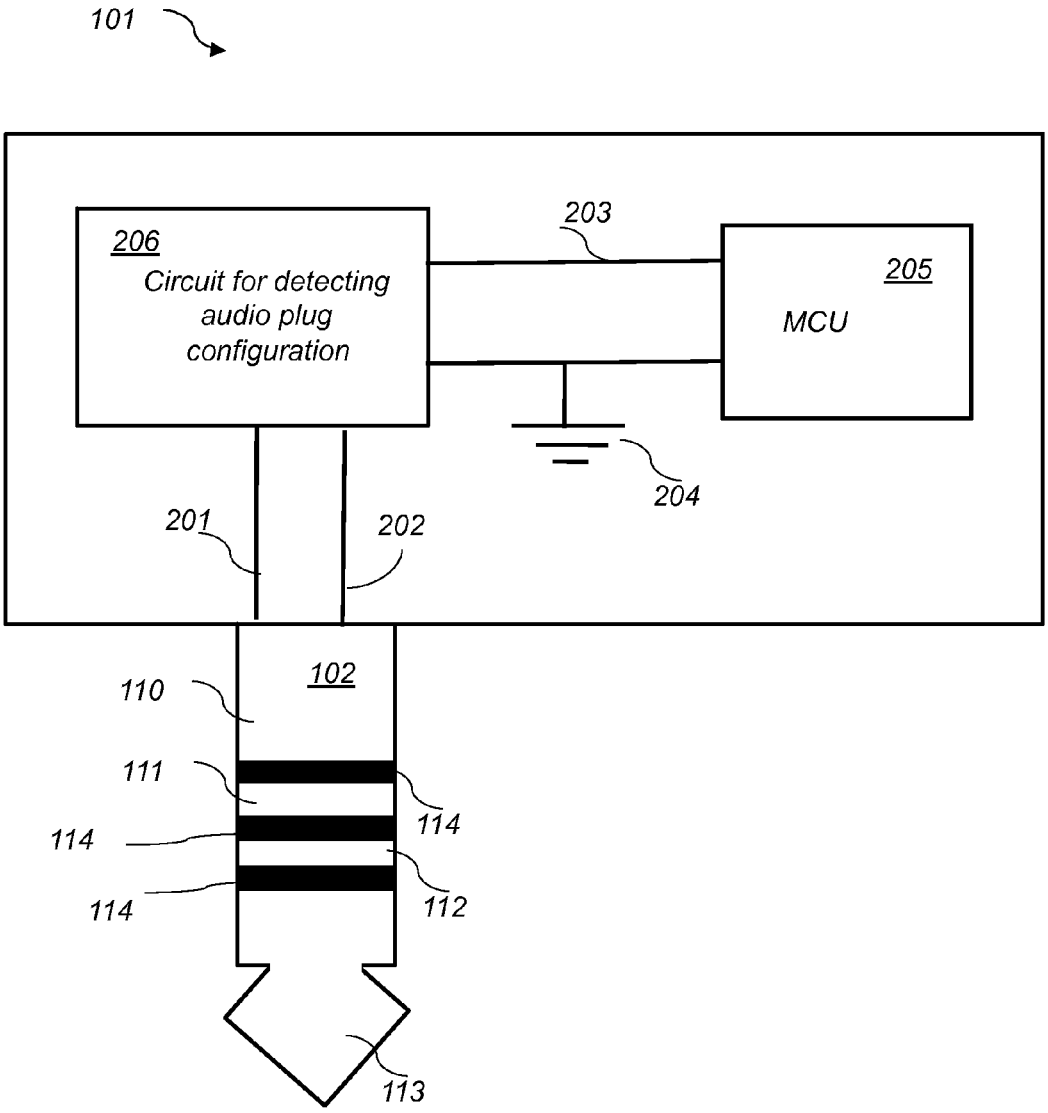
FIG. 2 is a schematic diagram of the accessory device.

Referring to FIG. 2, in a sample implementation, the accessory device 101 includes in addition to the audio jack 102, a microprocessor or microcontroller unit (MCU) 205, MCU output 203, ground (GND) 204, and a circuit 206 for detecting the audio plug configuration of a mobile phone. As was mentioned above, for the microprocessor or microcontroller (MCU) 205 of the accessory device to be able to communicate with the mobile phone properly, the GND 204 of the accessory device must connect to the GND of the mobile phone and the output 203 from the MCU must connect to the MIC-IN of the mobile phone. Circuit 206 is placed between the MCU 205 and audio jack 102 and detects the configuration of the mobile phone's audio plug and then establishes common GND between the accessory device and the mobile phone. In one example, audio jack connector 102 has the form of a 3-contact Tip-Ring-Sleeve (TRS) connector or a 4-contact Tip-Ring-Ring-Sleeve (TRRS) connector, shown in FIG. 2. Audio jack 102 includes MIC-IN contact 110, GND contact 111, R-CH contact 112, L-CH contact 113 and insulating rings 114.

Figure 3:
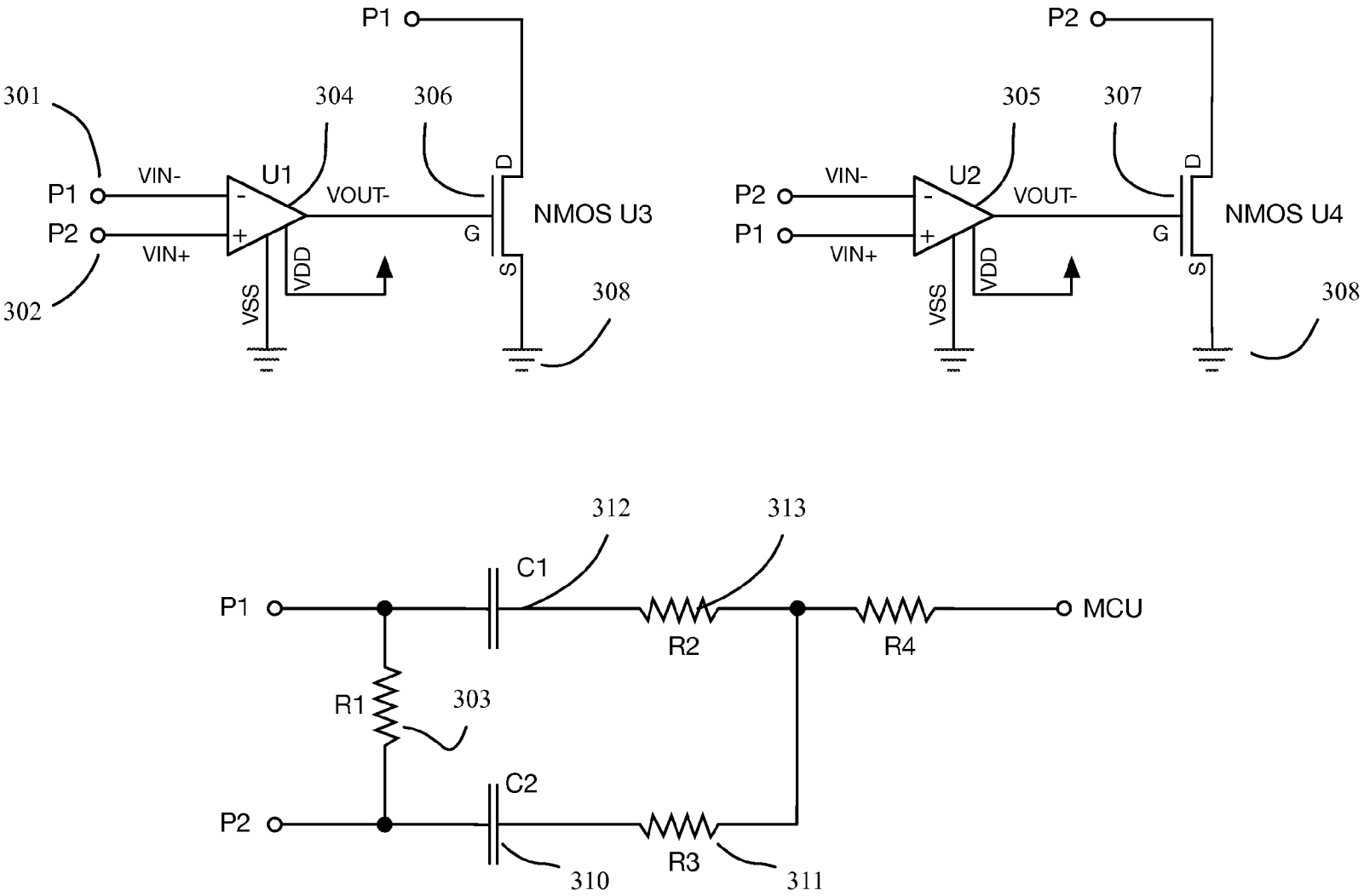
FIG. 3 depicts a first embodiment of a circuit for detecting the MIC-IN and GND of the audio port of a mobile phone, according to this invention.

Referring to FIG. 3, one embodiment of a circuit 206 includes contact points 301, 302, 308, comparators 304, 305 and switches 306, 307. Contact point 308 is the GND of the circuit and the GND of the accessory. Contact points 301 and 302 are connected to the two comparators 304 and 305 in a reverse way. In one example, comparators 304, 305 are implemented by operational amplifiers (OpAmps). Each comparator 304, 305 is connected to a switch 306, 307, respectively. In one example, switches 306, 307 are implemented by a N-MOSFET (NMOS) transistor. A resistor 303 is connected between the contact points 301 and 302 to establish a voltage difference between these two points. The contact points 110 and 111 of the audio jack 102 of the accessory 101 are connected to the contact points 301 and 302 of the circuit respectively.

The design of the invention works based on the fact that the MIC-IN signal on the mobile phone plug will have an offset voltage bias and will be at a higher voltage potential than the GND signal. When the accessory device 101 is plugged into audio plug 104 of the mobile phone 103 via the audio jack 102, contact points 110 and 111 of the accessory device 101 are connected to contact points 106 and 107 of the mobile phone, respectively. Therefore, contact points 106 and 107 of the audio plug 104 of the mobile phone 103 are connected to contact points 301 and 302 of the circuit 206, respectively.

If contact point 106 of the mobile phone 103 is connected to MIC-IN and contact point 107 of the mobile phone is connected to GND, the potential difference between contact points 301 and 302 will be positive. The output from the comparator 304 and 305 will be LOW and HIGH, respectively. Then the switch 307 will be turned ON and the switch 306 will remain OFF. Hence the GND of the accessory device and the GND of the mobile phone are connected together. The MIC-IN of the mobile phone is still fixed to some potential as the switch 306 is still OFF. The signal from the accessory device will go to contact point P1 301 (which is connected to the MIC-IN of the mobile phone) through capacitor 312 and resistor 313.

If contact point 106 of the mobile phone 103 is connected to GND and the contact point 107 of the mobile phone is connected to MIC-IN, the potential difference between input point 301 and 302 will be negative. The output from the comparator 304 and 305 will be HIGH and LOW, respectively. Then the switch 306 will be turned ON and the switch 307 will remain OFF. Hence the GND of the accessory device and the GND of the mobile phone are connected together. The MIC-IN of the mobile phone is still fixed to some potential as the switch 307 is still OFF. Signal from the accessory device will go to contact point P2 302 (which is connected to the MIC-IN of the mobile phone) through capacitor 310 and resistor 311.

Figure 4:
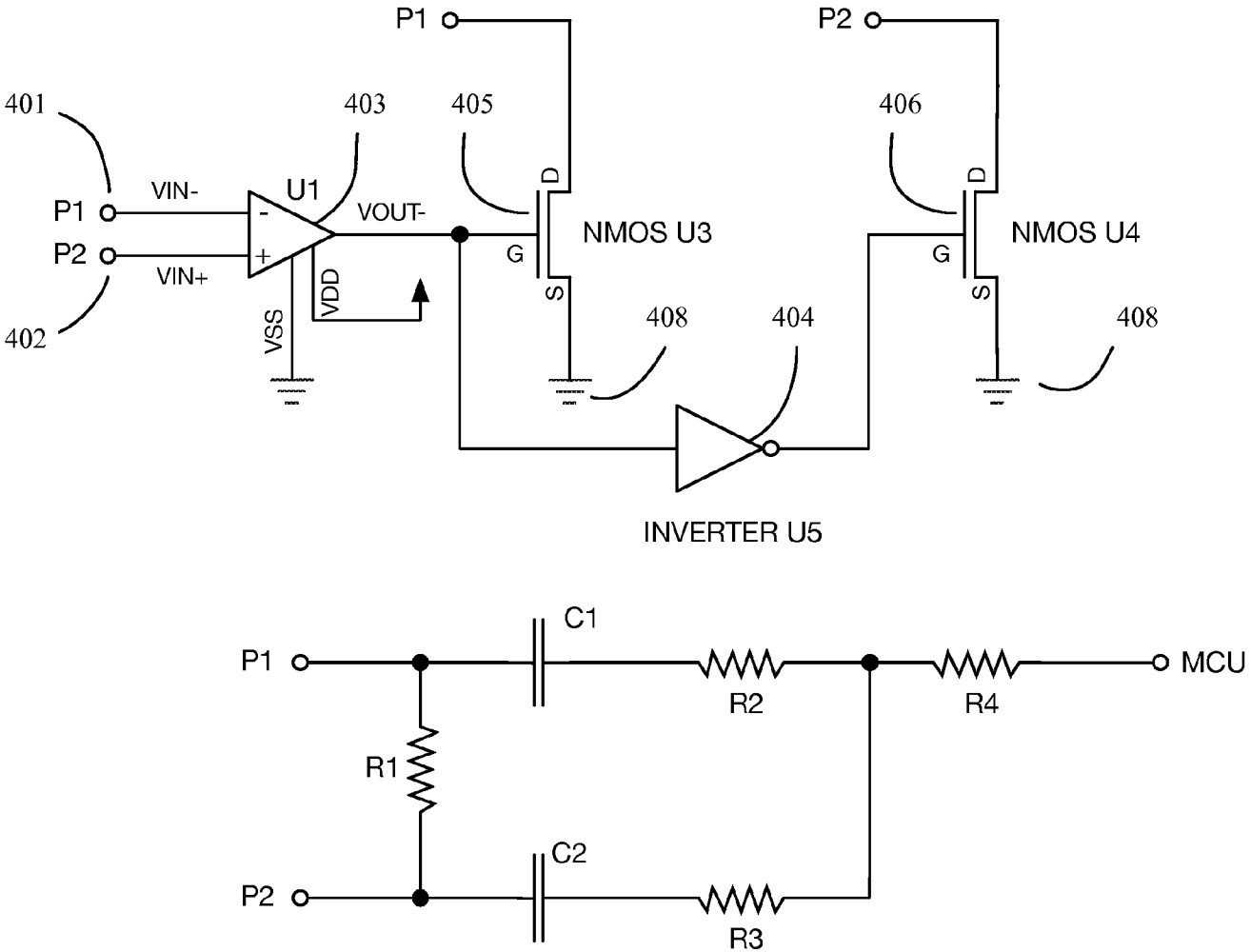
FIG. 4 depicts a second embodiment of a circuit for detecting the MIC-IN and GND of the audio port of a mobile phone, according to this invention.

Referring to FIG. 4, in another embodiment, instead of using two comparators, circuit 206 is implemented by one comparator 403 and one inverter 404. The output of the OpAmp 403 is connected to switch 405 and to the input of the inverter 404. The output of the inverter 404 is then connected to the switch 406. The inverter 404 reverses the output voltage from the comparator 403. Hence, either one of the switches 405 or 406 will be turned on. If the GND of the audio plug of the mobile phone is connected to contact point P1 401, the output from the comparator 403 is HIGH and the output of the inverter 404 is then LOW. The switch 405 will be turned on and the switch 406 will be turned off. Therefore, the GND of the audio plug of the mobile phone is connected to the GND 408 of the accessory device. If the GND of the audio plug of the mobile phone is connected to the contact point P2 402, the output from the comparator 403 is LOW and the output of the inverter 404 is then HIGH. The switch 405 will be turned off and the switch 406 will be turned on. Therefore, the GND of the audio plug of the mobile phone is also connected to the GND 408 of the accessory.

Figure 5:
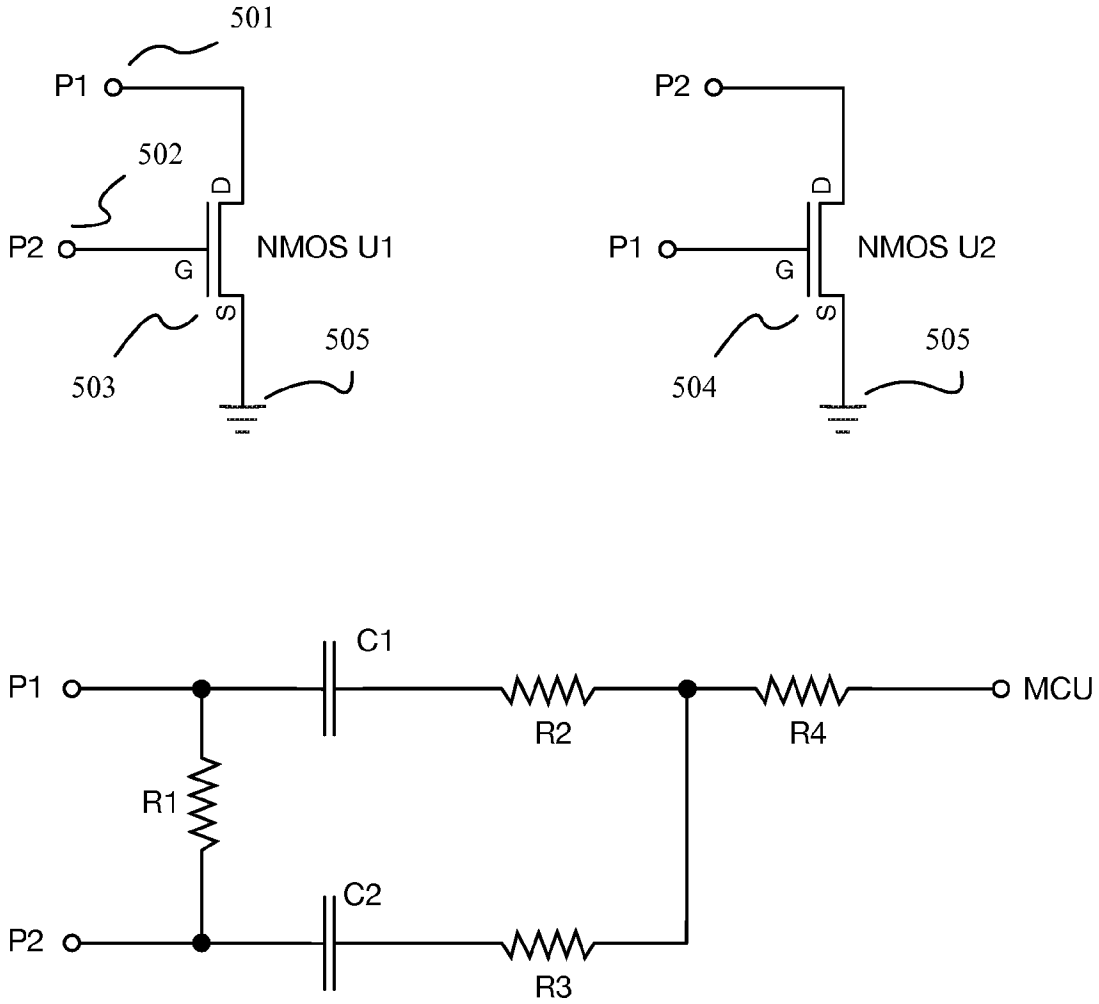
FIG. 5 depicts a third embodiment of a circuit for detecting the MIC-IN and GND of the audio port of a mobile phone, according to this invention.

Referring to FIG. 5, in another implementation circuit 206 includes two electronic switches 503, 504, which are NMOS transistors. Contact points P1 501 and P2 502 are connected to two switches 503 and 504 in a reverse way. Therefore, either one switch is turned on. Contact point 505 is the GND of the accessory. Hence, either contact point P1 501 or contact point P2 502 will be connected to the GND 505 of the accessory. If the GND and MIC-IN of the audio plug of the mobile phone are connected to contact points P1 501 and P2 502, respectively, switch 503 is turned on and switch 504 is turned off. Hence, the GND of the audio plug of the mobile phone is connected to the GND 505 of the accessory. If the GND and MIC-IN of the audio plug of the mobile phone are connected to contact points P2 502 and P1 501, respectively, switch 504 is turned on and the switch 503 is turned off. Hence, the GND of the audio jack of the mobile phone is also connected to the GND 505 of the accessory In the above described three embodiments, no matter what configuration of MIC-IN and GND of the mobile phone is, the GND of the accessory is always connected to the GND of the mobile phone and signal from the accessory is always going into the MIC-IN of the mobile phone.

Several embodiments of the present invention have been described. Nevertheless, it will be understood that various modifications may be made without departing from the spirit and scope of the invention. Accordingly, other embodiments are within the scope of the following claims.

What is claimed is:

1. A system comprising:

a mobile computing device comprising an audio plug, wherein said audio plug comprises first and second contacts;

a peripheral device comprising an audio jack, and a microprocessor; and a circuit connecting the audio jack and the microprocessor and used for detecting a microphone-in (MIC-IN) and a ground (GND) among the first and second contacts of the audio plug, wherein the MIC-IN comprises a higher voltage than the GND;

wherein said circuit comprises a first comparator connected to a first switch and a second comparator connected to a second switch and wherein the first comparator connects to the first and second contacts of the audio plug and measures a first voltage between the first and second contacts and the second comparator connects to the first and second contacts of the audio plug in a reverse way and measures a second voltage between the first and second contacts and wherein the circuit further compares the first and second voltages between the first and second contacts and thereby identifies the MIC-IN and GND among the first and second contacts of the audio plug;

wherein said circuit further comprises a resistor connected between first and second inputs of the first comparator and wherein the first and second inputs of the first comparator are connected to the first and second contacts of the audio plug and the resistor is used to establish the first voltage between the first and second inputs of the first comparator and the first and second contacts of the audio plug.

2. The system of claim 1, wherein the resistor is further connected between first and second inputs of the second comparator and wherein the first and second inputs of the second comparator are connected to the second and first contacts of the audio plug and the resistor is used to establish the second voltage between the first and second inputs of the second comparator and the second and first contacts of the audio plug.

3. The system of claim 2, wherein if the first voltage is low and the second voltage is high, the circuit turns the first switch on and the second switch off.

4. The system of claim 2, wherein if the first voltage is high and the second voltage is low, the circuit turns the second switch on and the first switch off.

5. The system of claim 1, wherein the first and second comparators comprise operational amplifiers.

6. The system of claim 1, wherein the first and second switches comprise N-MOS transistors.

7. A system comprising:

a mobile computing device comprising an audio plug, wherein said audio plug comprises first and second contacts;

a peripheral device comprising an audio jack, and a microprocessor; and a circuit connecting the audio jack and the microprocessor and used for detecting a microphone-in (MIC-IN) and a ground (GND) among the first and second contacts of the audio plug, wherein the MIC-IN comprises a higher voltage than the GND;

wherein said circuit comprises a comparator connected to a first switch and an inverter receiving input from the comparator and being connected to a second switch and wherein the first comparator connects to the first and second contacts of the audio plug and measures a first voltage between the first and second contacts and wherein the inverter receives the first voltage from the comparator and reverses the sign of the first voltage thereby generating a second voltage and wherein the circuit further compares the first and second voltages and thereby identifies the MIC-IN and GND among the first and second contacts of the audio plug.

8. The system of claim 7, wherein if the first voltage is high and the second voltage is low, the circuit turns the first switch on and the second switch off.

9. The system of claim 7, wherein if the first voltage is low and the second voltage is high, the circuit turns the second switch on and the first switch off.

10. The system of claim 1, wherein said circuit comprises a first switch and a second switch and wherein each of the first and second switches comprises N-MOS transistors.

11. The system of claim 10 wherein the first switch connects to the first and second contacts of the audio plug and the second switch connects to the first and second contacts of the audio plug in a reverse way.

12. The system of claim 1, wherein said audio jack connector comprises a ground (GND) contact, a microphone-in (MIC-IN) contact and one or more earphone channel contacts.

13. The system of claim 12, wherein said audio jack comprises one of a 4-contact Tip-Ring-Ring-Sleeve (TRRS) connector, 3-contact Tip-Ring-Sleeve (TRS) connector, a 3.5 mm audio jack, a 6.35 mm audio jack, a 2.5 mm audio jack, RCA connector, XLR connector, a banana connector, mono or stereo versions thereof.

14. The system of claim 12, wherein said audio plug further comprises one or more earphone channel contacts configured to connect to said audio jack one or more earphone channel contacts, respectively.

15. The system of claim 1, wherein said mobile computing device comprises one of a mobile phone, a personal digital assistant (PDA), netbook, tablet computer, notebook computer, game console, e-book reader, portable video player, or digital audio player.

16. The system of claim 1, wherein said peripheral device comprises one of a payment card reader, magnetic card reader, a printer, headphones, speakers, microphones, or hands-free versions thereof.

17. A peripheral device for use with a mobile computing device, the peripheral device comprising: an audio jack, the audio jack comprising first and second contacts; a microprocessor coupled to a circuit coupling the audio jack to the microprocessor and used for detecting a microphone-in (MIC-IN) and a ground (GND) among the first and second contacts of the audio jack, wherein the MIC-IN comprises a higher voltage than the GND; wherein the circuit comprises a first comparator connected to a first switch and a second comparator connected to a second switch and wherein the first comparator connects to the first and second contacts of the audio jack and measures a first voltage between the first and second contacts and the second comparator connects to the first and second contacts of the audio jack in a reverse way and measures a second voltage between the first and second contacts and wherein the circuit further compares the first and second voltages between the first and second contacts and thereby identifies the MIC-IN and GND among the first and second contacts of the audio jack; wherein said circuit further comprises a resistor connected between first and second inputs of the first comparator and wherein the first and second inputs of the first comparator are connected to the first and second contacts of the audio jack and the resistor is used to establish the first voltage between the first and second inputs of the first comparator and the first and second contacts of the audio jack.

18. A peripheral device for use with a mobile computing device, said peripheral device comprising: an audio jack, the audio jack comprising first and second contacts; a microprocessor coupled to a circuit coupling the audio jack to the microprocessor and used for detecting a microphone-in (MIC-IN) and a ground (GND) among the first and second contacts of the audio jack, wherein the MIC-IN comprises a higher voltage than the GND; wherein said circuit comprises a comparator connected to a first switch and an inverter receiving input from the comparator and being connected to a second switch and wherein the first comparator connects to the first and second contacts of the audio jack and measures a first voltage between the first and second contacts and wherein the inverter receives the first voltage from the comparator and reverses the sign of the first voltage thereby generating a second voltage and wherein the circuit further compares the first and second voltages and thereby identifies the MIC-IN and GND among the first and second contacts of the audio jack.

* * * * *